US010974260B2

(12) United States Patent
Currie et al.

(10) Patent No.: US 10,974,260 B2
(45) Date of Patent: Apr. 13, 2021

(54) GAPPED SCANNER NOZZLE ASSEMBLY AND METHOD

(71) Applicant: DLHBOWLES, INC., Canton, OH (US)

(72) Inventors: Timothy Currie, Silver Spring, MD (US); Sam Bernstein, Riva, MD (US); Gregory Russell, Catonsville, MD (US)

(73) Assignee: DLHBOWLES, INC., Canton, OH (US)

( * ) Notice: Subject to any disclaimer, the term of this patent is extended or adjusted under 35 U.S.C. 154(b) by 30 days.

(21) Appl. No.: 16/176,285

(22) Filed: Oct. 31, 2018

(65) Prior Publication Data

US 2019/0060920 A1 Feb. 28, 2019

Related U.S. Application Data

(63) Continuation of application No. PCT/US2018/057962, filed on Oct. 29, 2018, and a (Continued)

(51) Int. Cl.
*B05B 1/18* (2006.01)
*B05B 1/08* (2006.01)
(Continued)

(52) U.S. Cl.
CPC ..... *B05B 1/185* (2013.01); *B05B 1/08* (2013.01); *B05B 3/16* (2013.01); *B05B 1/18* (2013.01); *E03C 1/0408* (2013.01)

(58) Field of Classification Search
CPC .. B05B 1/18; B05B 1/185; B05B 1/08; E03C 1/0408
(Continued)

(56) References Cited

U.S. PATENT DOCUMENTS 3,185,166 A 5/1965 Horton
3,563,462 A 2/1971 Bauer
(Continued)

FOREIGN PATENT DOCUMENTS

CN 204620233 9/2015
JP 2009227209 10/2009
WO 2017091732 6/2017

OTHER PUBLICATIONS

International Searching Authority, United States Patent Office, International Search Report and Written Opinion for Application PCT/US2017030813, dated Oct. 2, 2017, International Searching Authority, US.

(Continued)

*Primary Examiner* — Joseph A Greenlund
(74) *Attorney, Agent, or Firm* — McDonald Hopkins LLC

(57) ABSTRACT

A fluidic scanner nozzle comprising an interaction chamber defined between an upstream end and a downstream end with a longitudinal chamber axis. The upstream end having an inlet opening for receiving and delivering pressurized fluid into said interaction chamber along said chamber axis. The downstream end having an outlet orifice for issuing a generally conical outlet spray of liquid droplets from said chamber into ambient environment and an axial gap positioned between said upstream end and said downstream end. The upstream and downstream ends may define inner cavities having a hemisphere shape. The axial gap may define a cylindrical sidewall segment aligned between an upper hemisphere shaped inner cavity and a lower hemisphere shaped inner cavity. The axial gap includes a selected axial length and an inside diameter that may be either a continuous axial gap or a stepped axial gap.

15 Claims, 10 Drawing Sheets

Related U.S. Application Data continuation-in-part of application No. 15/775,031, filed as application No. PCT/US2016/063608 on Jan. 23, 2016, and a continuation-in-part of application No. 16/094,221, filed as application No. PCT/US2017/030813 on May 3, 2017.

(60) Provisional application No. 62/578,079, filed on Oct. 27, 2017, provisional application No. 62/330,930, filed on May 3, 2016, provisional application No. 62/258,991, filed on Nov. 23, 2015.

(51) Int. Cl.
*B05B 3/16* (2006.01)
*E03C 1/04* (2006.01)

(58) Field of Classification Search
USPC ..... 239/589.1, 598
See application file for complete search history.

(56) References Cited

U.S. PATENT DOCUMENTS 4,052,002 A 10/1977 Stouffer
4,122,845 A * 10/1978 Stouffer ..... A61C 17/028 239/589.1
4,151,955 A 5/1979 Stouffer
4,157,161 A 6/1979 Bauer
4,184,636 A * 1/1980 Bauer ..... B05B 1/08 137/809
4,231,519 A 11/1980 Bauer
4,260,106 A * 4/1981 Bauer ..... B05B 1/08 137/811
RE31,683 E * 9/1984 Bauer ..... B05B 1/08 137/811
4,508,267 A 4/1985 Stouffer
5,035,361 A 7/1991 Stouffer
5,213,267 A * 5/1993 Heimann ..... B05B 1/1681 239/446
5,213,269 A 5/1993 Srinath
5,246,301 A 9/1993 Hirasawa
5,445,516 A * 8/1995 Stouffer ..... F23D 14/28 239/11
5,971,301 A 10/1999 Stouffer
6,186,409 B1 * 2/2001 Srinath ..... B05B 1/08 239/1
6,240,945 B1 6/2001 Srinath
6,253,782 B1 7/2001 Raghu
6,328,228 B1 * 12/2001 Bossini ..... B05B 1/1645 239/390
6,938,835 B1 * 9/2005 Stouffer ..... B05B 1/08 137/808
6,948,244 B1 9/2005 Crockett
7,111,800 B2 9/2006 Berning
7,293,722 B1 * 11/2007 Srinath ..... B05B 1/08 239/468
7,677,480 B2 3/2010 Russell
7,740,186 B2 6/2010 Macan
8,205,812 B2 6/2012 Hester
9,339,825 B2 * 5/2016 Koklu ..... F15C 1/22
2002/0109023 A1 * 8/2002 Thomas ..... B05B 15/528 239/562
2003/0127142 A1 * 7/2003 Stouffer ..... F15C 1/22 137/803
2006/0043110 A1 * 3/2006 Miyauchi ..... B05B 1/08 222/129.1
2006/0108442 A1 5/2006 Russell
2007/0158477 A1 7/2007 Wu
2007/0246577 A1 * 10/2007 Leber ..... B05B 15/652 239/589
2008/0073451 A1 * 3/2008 Bradbury ..... B05B 1/04 239/599
2010/0072307 A1 * 3/2010 Hester ..... B05B 1/14 239/589.1
2011/0061692 A1 * 3/2011 Gopalan ..... B60S 1/52 134/169 R
2011/0233301 A1 * 9/2011 Gopalan ..... B05B 1/08 239/101
2012/0175438 A1 * 7/2012 Ji ..... B05B 1/08 239/601
2013/0299608 A1 * 11/2013 Spangler ..... B05B 1/08 239/444
2016/0082447 A1 * 3/2016 Gong ..... B05B 1/08 239/461
2016/0228885 A1 * 8/2016 Cutler ..... B05B 1/185
2016/0318045 A1 * 11/2016 Huffington ..... B05B 1/185
2018/0318855 A1 * 11/2018 Russell ..... B05B 1/18
2019/0060920 A1 * 2/2019 Currie ..... B05B 3/16
2019/0201918 A1 * 7/2019 Russell ..... B05B 1/08

OTHER PUBLICATIONS

International Searching Authority, United States Patent Office, International Search Report and Written Opinion for PCT/US2016/063608, dated Apr. 17, 2017.
International Searching Authority, European Patent Office, International Search Report and Written Opinion for PCT/US2018/057962, dated Feb. 12, 2019.

* cited by examiner

| Gap Size (in) | Flow Rate (mL/min) | Cone Angle (deg) | Gap Size/IR Diameter | Flow Rate Relative to no Gap (%) | Cone Angle Relative to no Gap (%) |
|---|---|---|---|---|---|
| 0 | 1830 | 20 | 0 | 100 | 100 |
| 0.17 | 1840 | 18 | .25 | 100.5 | 90 |
| 0.34 | 1808 | 13 | .50 | 98.8 | 65 |
| 0.50 | 1802 | 12 | .75 | 98.5 | 60 |
| 0.675 | 1793 | 8 | 1.0 | 98.0 | 40 |
| 1.00 | 1765 | 6 | 1.5 | 96.4 | 30 |

FIG. 6A

| Gap Size (in) | Flow Rate (mL/min) | Cone Angle (deg) | Gap Size/IR Diameter | Flow Rate Relative to no Gap (%) | Cone Angle Relative to no Gap (%) |
|---|---|---|---|---|---|
| 0 | - | - | 0 | 100 | 100 |
| 0.17 | 1876 | 17 | .25 | 102.5 | 85 |
| 0.34 | 1858 | 12 | .50 | 101.5 | 60 |
| 0.50 | 1816 | 10 | .75 | 99.2 | 50 |
| 0.675 | 1789 | 8 | 1.0 | 97.7 | 40 |
| 1.00 | 1790 | 5 | 1.5 | 97.8 | 25 |

FIG. 6B

GAPPED SCANNER NOZZLE ASSEMBLY AND METHOD

CROSS-REFERENCE TO RELATED APPLICATIONS

This application is a continuation of International Application No. PCT/US2018/057962 entitled "GAPPED SCANNER NOZZLE ASSEMBLY AND METHOD," filed on Oct. 29, 2018 which claims priority to and benefit of U.S. Provisional Application No. 62/578,079 filed on Oct. 27, 2017, which is hereby incorporated by reference in its entirety. This application is also a continuation-in-part of U.S. application Ser. No. 15/775,031 entitled "SCANNER NOZZLE ARRAY, SHOWERHEAD ASSEMBLY AND METHOD," filed May 10, 2018 which is a 371 national phase entry application of PCT/US2016/063608 entitled "SCANNER NOZZLE ARRAY, SHOWERHEAD ASSEMBLY AND METHOD," filed on Nov. 23, 2016 which claims priority to and benefit of U.S. Provisional Application No. 62/258,991 filed on Nov. 23, 2015. This application is also a continuation-in-part of U.S. application Ser. No. 16/094,221 entitled "FLUIDIC SCANNER NOZZLE AND SPRAY UNIT EMPLOYING SAME," filed Oct. 17, 2018 which is a 371 national phase entry application of PCT/US2017/030813 entitled "FLUIDIC SCANNER NOZZLE AND SPRAY UNIT EMPLOYING SAME," filed on May 3, 2017 which claims priority to and benefit of U.S. Provisional Application No. 62/330,930 filed on May, 3, 2016. This application is also related to commonly owned U.S. Pat. Nos. 6,938,835; 6,948,244; 7,111,800; 7,677,480; and 8,205,812; which disclose prior scanner fluidic oscillator, multiple fluidic enclosures, and methods of integrating fluidic geometry (exit geometry) into the housing of a fluidic device. The entire disclosures of all of the foregoing are hereby incorporated herein by reference.

FIELD OF THE DISCLOSURE

The present disclosure pertains generally to methods and apparatus for fluidically generating desired fluid spray patterns, primarily liquid patterns sprayed in droplets to reliably wet a target area. In a more particular aspect, the invention pertains to enhancements to fluidic oscillator nozzles, their use in spray assemblies (e.g., showerheads) configured to generate a plurality of predetermined aimed three-dimensional oscillating sprays of fluid droplets from a plurality of fluidic scanner nozzles, and methods of fabricating such assemblies.

BACKGROUND

Standard jet-type shower heads do not provide pleasing spray pattern, uniform droplet size, uniform droplet velocity, and temperature uniformity at very low flow rates (e.g., 2 gpm or less) for showering. Any fluidic showerhead can provide improvements over the prior art. Most fluidic showerheads have very few openings and are, therefore, judged inferior by consumers at stores where they cannot spray the showerhead before purchasing.

FIGS. 1A-1D illustrate Applicant's prior work in the related arts, wherein U.S. Pat. No 6,938,835 (Stouffer), assigned to the assignee of the present invention, relates to a three-dimensional (3-D) scanning nozzle operating in the liquid-to-air mode, and more particularly, to a 3-D scanning nozzle in which a single jet has long wavelengths so that slugs of fluid persist for greater distances from the nozzle, thereby providing superior cleaning for hard surfaces by impact and abrasion. Prior full coverage sprays have been accomplished by fluidic oscillators that sweep sheets (e.g. see. Stouffer U.S. Pat. No. 4,151,955) or by mechanically traversing a sweeping jet over the target surface (as is done in the case of some headlamp washers). Many cleaning jets distribute energy by spreading the jet and rely on wand traversing to providing further distribution. Superior cleaning has been shown by sweeping-jets issued from a fan nozzle of the type shown in Stouffer U.S. Pat. No. 4,508,267 over that of a spread jet, with static (non-sweeping) nozzle on headlamp cleaning nozzles. According to the Stouffer '835 scanner nozzle patent, a single, concentrated jet that is time-shared over an area is superior to static, multi-jet nozzles that sweep just like a fan, so in order to obtain a full-coverage spray pattern that is also more uniform in both pattern distribution as well as droplet size, the Stouffer '835 patent relies on a type of fluidic oscillator that produces a random scan in both radial and tangential directions.

The Stouffer '835 scanner patent describes and illustrates (e.g., in FIGS. 1A-1D) a full coverage area spray nozzle member 10 having a cylindrical oscillation chamber bounded by an upstream end plate and a downstream end plate. An inlet aperture in the upstream end plate is coupled to a source of pressurized liquid to be sprayed on the area, and an outlet aperture at the downstream end issues a jet of the pressurized liquid to ambient. In this patent, the cylindrical wall of the oscillation chamber is defined by a line revolved about an axial line passing through the inlet aperture and the outlet aperture. The oscillation chamber is adapted to support a basic oscillatory toroidal flow pattern which remains captive within the confines of that chamber. The toroid spins about its cross-sectional axis and is supplied with energy from the jet of liquid issued into the oscillation chamber. The toroidal flow pattern has diametrically opposed cross-sections which alternate in size to cause the outlet jet to move in radial paths and also in tangential directions and thereby moves in a different radial path at each sweep, whereby there is a random sweeping, or scanning, of the jet issuing from the outlet aperture over the spray area.

Fluidic oscillators can be assembled into a multi-spray generating nozzle assembly such as those illustrated in FIGS. 2A-2B and FIGS. 3A-3C. FIGS. 2A-2B illustrate applicant's prior version of enclosures for multiple fluidic oscillators. FIGS. 2A-2B show perspective views of the front face 30 and rear face 24, respectively of a commercial version of a showerhead 20 formed of a housing that accommodates twelve fluidic oscillators 29. The geometrical arrangement of this housing's twelve passages 32 and their inserted oscillators 29 is seen to include an outer octagonal array of eight fluidic oscillator-containing passages that are centered on the center-point 28 of the front face 30. Inside this outer array is located an inner array of four fluidic-oscillator-containing passages 22 that are also centered on the center-point 28 of the enclosure's front face 30.

FIGS. 3A-3C illustrates another earlier prototype of a multi-spray generating showerhead assembly 50. The scanner showerhead 50 preferably is of a molded plastic material and includes a two-piece housing 52 having a rear (or top as viewed in FIG. 3A) housing component 54 and a front plate housing component 56 mated at an interface 58 to form an enclosed plenum which encloses the fluidic oscillator elements. The top housing component 54 incorporates a fluid inlet 60 for connection to a source of fluid under pressure, such as a conventional sprayer, shower supply fixture or hose, to which it is connected by external threads 62. The diameter of the interior 64 of the inlet is stepped down, as at a first inwardly extending shoulder 66, a second inner shoulder 68 which is secured to an inner wall 69 formed by shoulder 66, and a final inwardly extending shoulder 70 to form a small-diameter inlet 71 through which fluid flows, as indicated by arrows 72, into the interior plenum 74 defined between the rear and front components, or portions, 54 and 56 of the housing 52. In the illustrated embodiment, the inner shoulder 68 is in the form of a ring secured to wall 69 by, for example, radial arms indicated at 78, with the spaces 79 between the radial arms directing fluid flow indicated by arrows 80 into the plenum and cooperating with the central opening 71 to reduce turbulence in the fluid flow into the plenum 74 for even distribution of the flow to the outlet fluidic oscillators.

The top housing portion 54 is generally cup-shaped, forming a housing cover portion having a top wall 90, which incorporates the centrally-located inlet 60, and a circumferential, downwardly-extending (as viewed in FIG. 3A) side wall 92 having at its bottom an outwardly-flared circumferential sealing flange 94 which incorporates a flat bottom sealing surface 96. As best seen in FIG. 3B, the housing cover 54 incorporates around the sidewall 92 a plurality of outwardly-extending radial protrusions 100 spaced around the housing side wall. Each protrusion includes a through aperture 102 which is aligned with a corresponding aperture 104 in the bottom housing 56 for receiving a suitable fastener for assembly of the showerhead 50. It will be noted that at the location of each outward protrusion 100, the wall 92 of top housing component 52 incorporates a curved, inwardly-extending projection, or bulge 110, as best seen in FIG. 3C, which serves to provide sufficient thickness in the side wall 92 to accept the apertures 102. The multiple protrusions and their corresponding inward projections produce a curved circumferential inner wall surface 112, as seen in FIGS. 3A and 3C.

The bottom, or front plate housing component 56 of the housing 52 includes a generally planar bottom wall 120 having a back (or top, as viewed in FIG. 3A) surface 122, a front surface 124, and a circumferential wall 126. As best seen in FIG. 3B, the housing component 56 includes multiple circumferentially-spaced apertures 104, with the back surface 122 incorporating a sinuous sealing groove 130 having inner and outer walls 132 and 134 and a groove bottom 136 for receiving a flexible circular seal (not shown). The inner wall 132 of the sealing groove follows the curvature of the curved inner wall 112, so that when the housing 52 is assembled, upper and lower parts 54 and 56 of the housing engage at interface 58 with the surface 96 of the top housing 54 engaging the back surface 122 of bottom housing 56 and covering the sealing groove 130 to provide a fluid-tight seal between these upper and lower components when a suitable flexible seal is in the groove 130.

Molded as a part of the front plate housing component 56 are a plurality of concave depressions 150, illustrated in perspective view in FIG. 3B, which form the lower halves of fluidic oscillators for the sprayer 50. For clarity, only one such depression will be described in detail, it being understood that all of them, in this case eight, are substantially alike and are formed during the molding process for making the component 56. In this embodiment, each depression is molded to incorporate a cylindrical upper portion 152, an inward ledge, or shoulder 154, and a substantially hemispherical lower cavity portion 156 which will form a lower part of a two-piece scanner fluidic oscillator element when the scanner showerhead is assembled. At the bottom of the lower cavity portion, slightly offset radially outwardly from a centerline of the fluidic oscillator, and thus off center of the depression 150, is an outlet aperture 158 which opens through a throat portion 160 formed in a wall portion 162 of the depression 150. As best seen in FIG. 3C, the throat portion 160 flares outwardly from the aperture 158 to produce a particular scanning fluid spray pattern.

Mounted within each depression 150, as illustrated in FIG. 3A, is a corresponding cylindrical fluidic power nozzle insert 170, which forms the second part of the two-part fluidic oscillator. The insert has an upper planar surface 172 and a cylindrical side wall 174 which has a diameter selected to fit snugly into the upper portion 152 of its corresponding depression. As illustrated in the cross-section of FIG. 3A, the bottom of each insert incorporates an open, downwardly facing substantially hemispherical dome 176 having a cylindrical bottom edge 178 which engages the ledge 154 in its corresponding depression when assembled. The inert dome and its corresponding depression form a spherical fluidic oscillator interaction chamber 180. Centrally located in the upper surface of each cylindrical insert is an inlet passage 182 having an axis 184, which is also the axis of the cylindrical insert 170, and forming a power nozzle leading into the insert interior dome and thus into the interaction chamber 180 formed by each insert with its corresponding depression. As illustrated in FIG. 3A, it will be noted that the outlet apertures 158, and the throats 160 of each fluidic oscillator are offset radially from the axis 184, and as illustrated, these offsets are of selected, usually different dimensions to provide predetermined different but complementary outlet spray patterns of each oscillator output scanner spray. In the illustrated embodiment, the outlets are spaced radially outwardly by different distances 186 and 188 in the two fluidic oscillators illustrated in cross-section in FIG. 3A, but it will be understood that the offset may be in any direction from the axis 184, the offsets may all be the same, or a selected mixture of offsets, or there may be no offsets, as selected for the desired scanner spray pattern. It is noted that the inserts may be partially serrated around their upper edges 190 for ease of handling.

The method of assembly of showerhead 50 involves positioning an insert 170 into each of the cylindrical upper portions 152 of depressions 150 in the front plate so that the bottom 178 of the insert engages the ledge 154, with the inserts being secured in place by the tight fit of the insert outer side wall 174, thereby forming a plurality, in this embodiment for purposes of illustration, eight fluidic oscillator interaction chambers and corresponding scanning spray outlets and outlet throats. A seal is placed in the groove 130 and the back and front portions 54 and 56 are positioned and aligned and are secured together by suitable fasteners, such as screws or bolts, to provide a fluid-tight enclosure. In operation, the shower head is secured to a suitable source of fluid under pressure, which flows into the interior plenum, or fluid manifold 74 of the housing, as indicated by arrows 72 and 80. The fluid circulates in the chamber and flows at substantially equal flow rates into the several inlet power nozzles 182, as illustrated by arrows 190. The fluid enters the fluidic interaction chambers 180 under pressure, circulates in the chamber to produce a fluidic oscillation, and is ejected through the corresponding outlet aperture 158 and throat 160 to generate from each outlet a scanning fluidic spray output which is delivered in a uniform cone angle, illustrated in FIG. 3A by arrows 192. This scanning spray output may randomly scan across and around the defined cone angle to produce a highly desirable flow pattern for use, for example in a shower.

In the described embodiment of FIGS. 3A-3C, the spherical shape of the interaction chambers 180 was assumed to be critical for performance of the fluid oscillation produced. However, these prior art fluidic showerheads may be more difficult to manufacture because of the difficulty in sealing of the fluidic passages and the requirement for tight tolerances in manufacturing, fixturing and assembly. Further, these embodiments of known fluidic showerheads tend to be more expensive than conventional jet showers because of the number of fluidic nozzle components required. Thus, there is a need to provide improvements to these known assemblies to improve manufacturability, reduce cost, and provide further control of fluidic behavior.

SUMMARY

Accordingly, it is an object of the present disclosure to overcome the above mentioned difficulties by providing a gapped scanner nozzle assembly. The gapped scanner nozzle assembly of the present invention may be used to assemble a multiple spray generating scanner fluidic showerhead which provides all of the benefits of a fluidic showerhead, with additional advantages. The gapped scanner nozzle assembly, if configured as a scanner fluidic showerhead, may contain many spray orifices or openings (more fluidics), in an assembly which is easy and inexpensive to assemble.

The gapped scanner nozzle assembly includes an inlet lumen hemisphere defining member and an outlet orifice hemisphere defining member which is configured to receive and axially align with the inlet defining member in a congruent relationship. The gapped scanner assembly works surprisingly well when there is an axial or longitudinal gap between the hemisphere halves and the gap defines a cylindrical sidewall having a selected axial length. In one embodiment, the cylindrical sidewall includes a wider inside diameter than the inside diameters of either (a) the inlet lumen hemisphere defining member or (b) outlet orifice hemisphere defining member. In another embodiment, the cylindrical sidewall includes an inside diameter that is generally congruent to the inside diameter of either (a) the inlet lumen hemisphere defining member or (b) outlet orifice hemisphere defining member. The gapped scanner nozzle assembly defines a lumen or vortex inducing chamber between the backing (power nozzle) defining member and the front member.

The method of manufacture and configuration of the present invention provides an economical and very effective mechanism for incorporating scanner fluidic circuits in a multi-spray generating assembly. The gapped scanner nozzle assembly of the present invention need not be as expensive to make as prior fluidic showerheads because there can be fewer components which are assembled in a less tolerance-critical method as compared with prior fluidic showerheads.

In one embodiment, a fluidic scanner nozzle comprising an interaction chamber defined axially between an upstream end and a downstream end and having a longitudinal chamber axis. The upstream end having an inlet opening for receiving pressurized fluid and delivering the pressurized fluid into said interaction chamber along said chamber axis. The downstream end having an outlet orifice for issuing a generally conical outlet spray of liquid droplets from said chamber into ambient environment. An axial gap positioned between said upstream end and said downstream end. The upstream end may be an inlet member that defines an inner cavity having a hemisphere shape and the downstream end may be an outlet member that defines an inner cavity having a hemisphere shape wherein the inner cavity of the inlet member is an upper hemisphere shape and the inner cavity of the outlet member is a lower hemisphere shape. The outlet member may be configured to receive and be axially aligned with the inlet member in a congruent relationship to form said interaction chamber. The axial gap may be positioned between a portion of the inlet member and the outlet member. The axial gap may define a cylindrical sidewall segment aligned between an upper hemisphere shaped inner cavity and a lower hemisphere shaped inner cavity. The axial gap may include a selected axial length and an inside diameter that is wider than an inside diameter of either (a) the inlet member or (b) the outlet member. The axial gap may be a stepped axial gap positioned between a portion of the inlet member and the outlet member. Alternatively, the axial gap may be a continuous axial gap positioned between a portion of the inlet member and the outlet member. The axial gap within said interaction chamber may define a vortex inducing chamber between the inlet member and the outlet member.

In one embodiment provided is a fluidic scanner nozzle comprising an interaction chamber defined axially between an inlet member and an outlet member and having a longitudinal chamber axis. The inlet member including an upstream end having an inlet opening for receiving pressurized fluid and delivering the pressurized fluid into said interaction chamber along said chamber axis. The outlet member including a downstream end having an outlet orifice for issuing a generally conical outlet spray of liquid droplets from said chamber into ambient environment. An axial gap may be positioned between said upstream end and said downstream end. The inlet member and outlet member may be secured and sealed together to define said interaction chamber therebetween, said inlet member including a first open end longitudinally opposite said inlet opening and said outlet member including a second open end longitudinally opposite said outlet orifice, and wherein said first open end is inserted within said second open end. The inlet member defines an inner cavity having a hemisphere shape and said outlet member defines an inner cavity having a hemisphere shape wherein the inner cavity of the inlet member is an upper hemisphere shape and the inner cavity of the outlet member is a lower hemisphere shape. The outlet member may be configured to receive and be axially aligned with the inlet member in a congruent relationship to form said interaction chamber. The axial gap defines a cylindrical sidewall segment aligned between an upper hemisphere shaped inner cavity and a lower hemisphere shaped inner cavity. The axial gap includes a selected axial length and an inside diameter that is wider than an inside diameter of either (a) the inlet member or (b) the outlet member. The axial gap may be a stepped axial gap positioned between a portion of the inlet member and the outlet member. Alternatively, the axial gap may be a continuous axial gap positioned between a portion of the inlet member and the outlet member. The outlet member may further comprise a continuous face having a plurality of outlet members configured to be aligned with a plurality of inlet members within a housing wherein said housing is a shower head assembly.

The above and still further objects, features and advantages of the present invention will become apparent upon consideration of the following detailed description of specific embodiments thereof, particularly when taken in conjunction with the accompanying drawings, wherein like reference numerals in the various figures are utilized to designate like components.

BRIEF DESCRIPTION OF THE DRAWINGS

The operation of the present disclosure may be better understood by reference to the following detailed description taken in connection with the following illustrations, wherein:

FIG. 6A is a table illustrating various measurements related to various gap sizes for fluidic oscillators having a continuous gap according to the present disclosure; and FIG. 6B is a table illustrating various measurements related to various gap sizes for fluidic oscillators having a stepped gap according to the present disclosure.

DETAILED DESCRIPTION

Figure 1A:
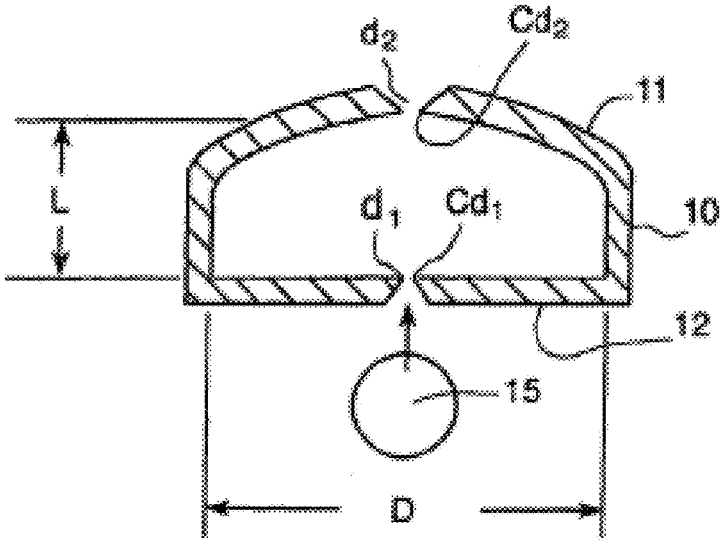
FIG. 1A (prior art)
FIG. 1A is a schematic illustration of an embodiment of a prior art configuration that includes a cylinder with a dome-top or end plate for producing an oscillating toroid.
Figure 1B:
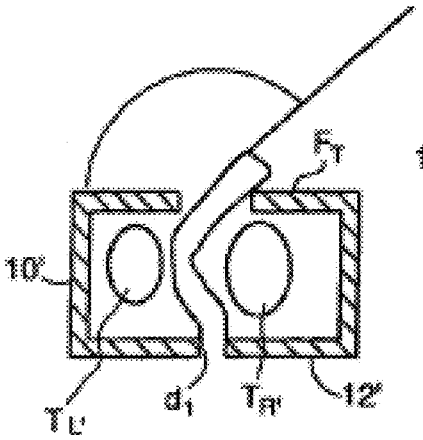
FIG. 1B (prior art)
FIG. 1B is a schematic illustration of another embodiment of a prior art configuration that includes a flat-topped member or end plate for producing an oscillating toroid.
Figure 1C:
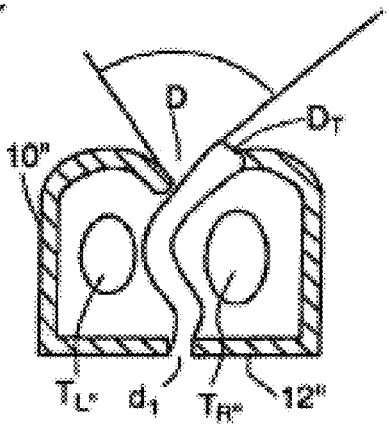
FIG. 1C (prior art)
FIG. 1C is a schematic illustration of another embodiment of a prior art configuration that includes an outlet aperture in a dimpled-top member for producing an oscillating toroid.
Figure 1D:
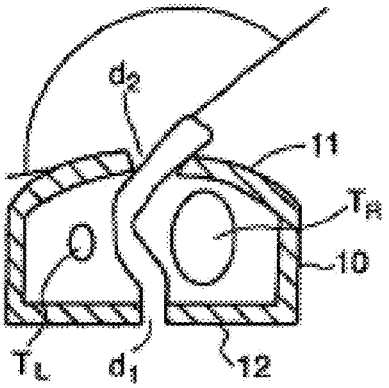
FIG. 1D (prior art)
FIG. 1D is a diagrammatic illustration of the prior art configuration illustrating a functional aspect of FIG. 1A.
Figure 2A:
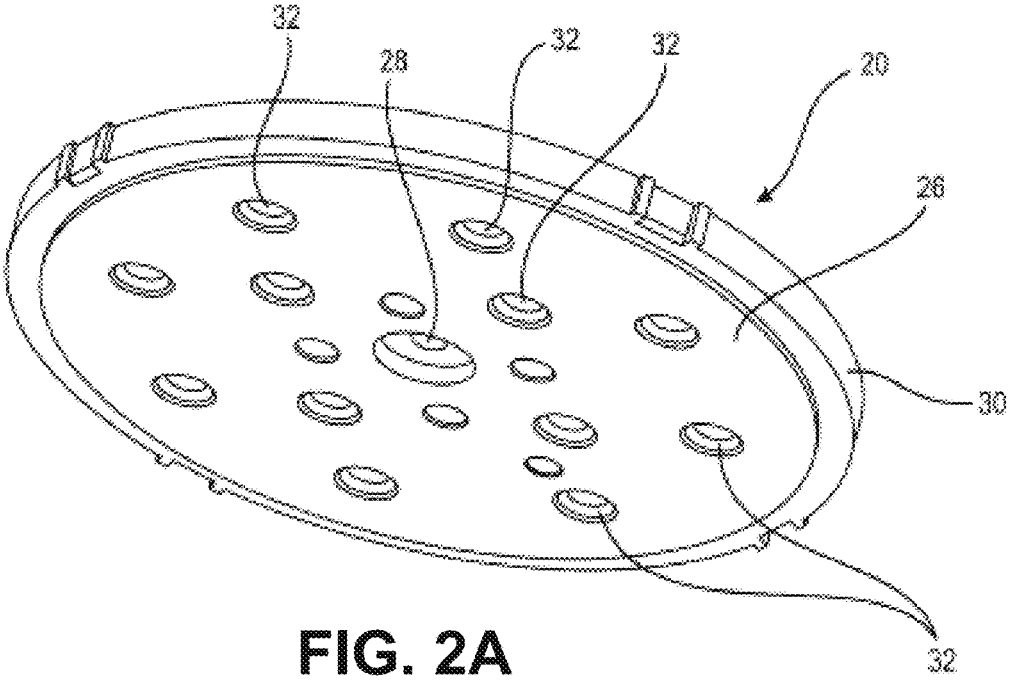
FIG. 2A (Prior Art)
FIG. 2A illustrates a perspective view of a prior art embodiment of a front face and a rear face of a housing that accommodates fluidic oscillators.
Figure 2B:
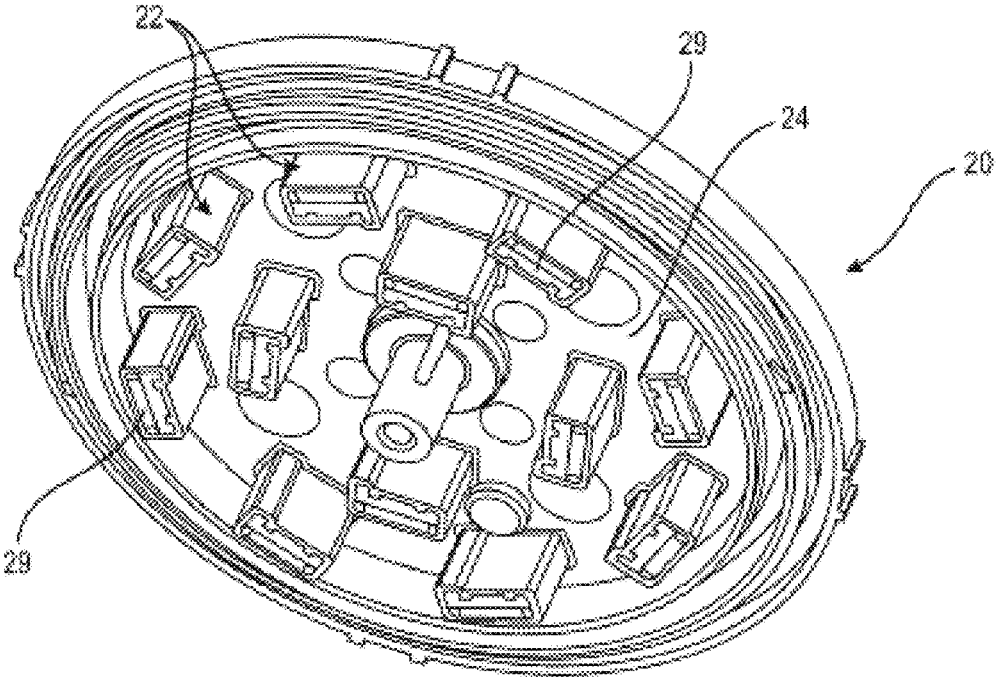
FIG. 2B (Prior Art)
FIG. 2B illustrates a perspective view of a prior art embodiment of a front face and a rear face of a housing that accommodates fluidic oscillators.

Reference will now be made in detail to exemplary embodiments, examples of which are illustrated in the accompanying drawings. It is to be understood that other embodiments may be utilized and structural and functional changes may be made. Moreover, features of the various embodiments may be combined or altered. As such, the following description is presented by way of illustration only and should not limit in any way the various alternatives and modifications that may be made to the illustrated embodiments.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Similar reference numerals are used throughout the figures. Therefore, in certain views, only selected elements are indicated even though the features of the system or assembly may be identical in all of the figures. In the same manner, while a particular aspect of the disclosure is illustrated in these figures, other aspects and arrangements are possible, as will be explained below.

In the described embodiment of FIGS. 3A-3D, the spherical shape of the interaction chamber 180 was assumed to be critical for performance of the fluid oscillation produced. The fluid spray pattern generated sweeps or scans in a preselected conical pattern size and direction. Fluid from the oscillation chamber is ejected in a variable-direction spray that scans randomly across a selected area that is defined by the conical outer shape of the spray pattern. A study was conducted to determine if improvements were available to improve tolerances due to manufacturability and whether changes in tolerances or arrangement would have a demonstrable effect on the behavior of the fluid spray pattern.

This study determined that the shape of the interaction chamber may be adjusted to improve tolerances related to manufacturability and assembly while maintaining performance of fluidic circuit as measured by flow rate and cone angle. The variability of a step geometry was identified to adjust both the flow rate and cone angle at identifiable relationships that will be discussed below.

Provided is an embodiment of a gapped scanner nozzle assembly 200 and its components parts. In one embodiment, referring now to FIG. 4A, the gapped scanner nozzle assembly 200 of the present disclosure is configured in an economical method to generate a fluidic spray output which delivers a spray with a surprisingly uniform cone angle 220. In one embodiment, the gapped scanner nozzle assembly 200 comprises a two-part fluidic oscillator may be utilized with a plurality of similar assemblies, that may or may not include the gapped feature, in a housing similar as identified in FIGS. 3A-3C above. Additionally, the gapped scanner nozzle assembly 200 may be used independently of a shower head housing.

The gapped scanner nozzle assembly may include an inlet member 210 that defines an upper inner cavity and an outlet member 230 that defines a lower inner cavity. The inner cavity of the inlet member 210 may define an upper hemisphere shape and the inner cavity of the outlet member 230 may define a lower hemisphere shape. The outlet member 230 may be configured to receive and be axially aligned with the inlet member 210 in a congruent relationship. The gapped scanner assembly 200 may include an axial or longitudinal gap 250 between a portion of the inlet member 210 and the outlet member 230 wherein the axial gap may define a cylindrical sidewall segment aligned between an upper hemisphere shaped inner cavity and a lower hemisphere shaped inner cavity. The axial gap may have a selected axial length and a wider inside diameter than the inside diameters of either (a) the inlet lumen hemisphere defining member or (b) outlet orifice hemisphere defining member. The gapped scanner nozzle assembly 200 defines a lumen or vortex inducing chamber between the backing (power nozzle) defining member and the front member.

The fluidic scanner nozzle assembly may be considered a gapped fluidic nozzle assembly 200. This nozzle includes an interaction chamber 260 defined axially between an upstream end 212 and a downstream end 232 and having a longitudinal chamber axis 270. The upstream end having an inlet opening 214 for receiving pressurized fluid and delivering the pressurized fluid into said interaction chamber 260 along said chamber axis 270. The downstream end 232 having an outlet orifice 234 for issuing a generally conical outlet spray 220 of liquid droplets from the interaction chamber 260 into ambient environment.

The axial gap 250 may be positioned between said upstream end 212 and said downstream end 232. More particularly, the outlet member 230 is configured to receive and be axially aligned with the inlet member 210 in a congruent relationship to form said interaction chamber 260. Wherein the axial gap 250 is positioned between a portion of the inlet member 210 and the outlet member 230. In one embodiment, the axial gap 250 defines a cylindrical sidewall segment aligned between an upper hemisphere shaped inner cavity and a lower hemisphere shaped inner cavity. The axial gap 250 within said interaction chamber 260 defines a vortex or toroidal flow inducing chamber between the inlet member and the outlet member.

As illustrated by FIGS. 4A through 4D, the axial gap may be a stepped axial gap. Here, the inlet member 210 may include a shoulder 216 that protrudes outwardly therefrom. The shoulder 216 may be an annular member that radially protrudes about a side of the inlet member 210 and is configured to abut against an opening of the outlet member 230. The inlet member 210 including a first open end 218 longitudinally opposite said inlet opening 214 and said outlet member 230 including a second open end 237 longitudinally opposite said outlet orifice 234. The first open end 218 may be is inserted within said second open end 238.

The outlet member 230 may include a step portion 236. The step portion 236 may be an annular shoulder located within the cavity of the outlet member 230. Once the inlet member 210 is inserted within the outlet member 230, the shoulder 216 may abut against the second open end 238 such that the stepped axial gap 250 is formed between the first open end 218 and the step portion 236 of the outlet member 230.

The axial gap 250 may be of a generally cylindrical shape within the interaction chamber 260 and may includes a selected axial length between the first open end 218 and the step portion 236. Further, the axial gap may include an inside diameter that is wider than an inside diameter of either (a) the cavity of the inlet member or (b) the cavity of the outlet member.

Figure 3A:
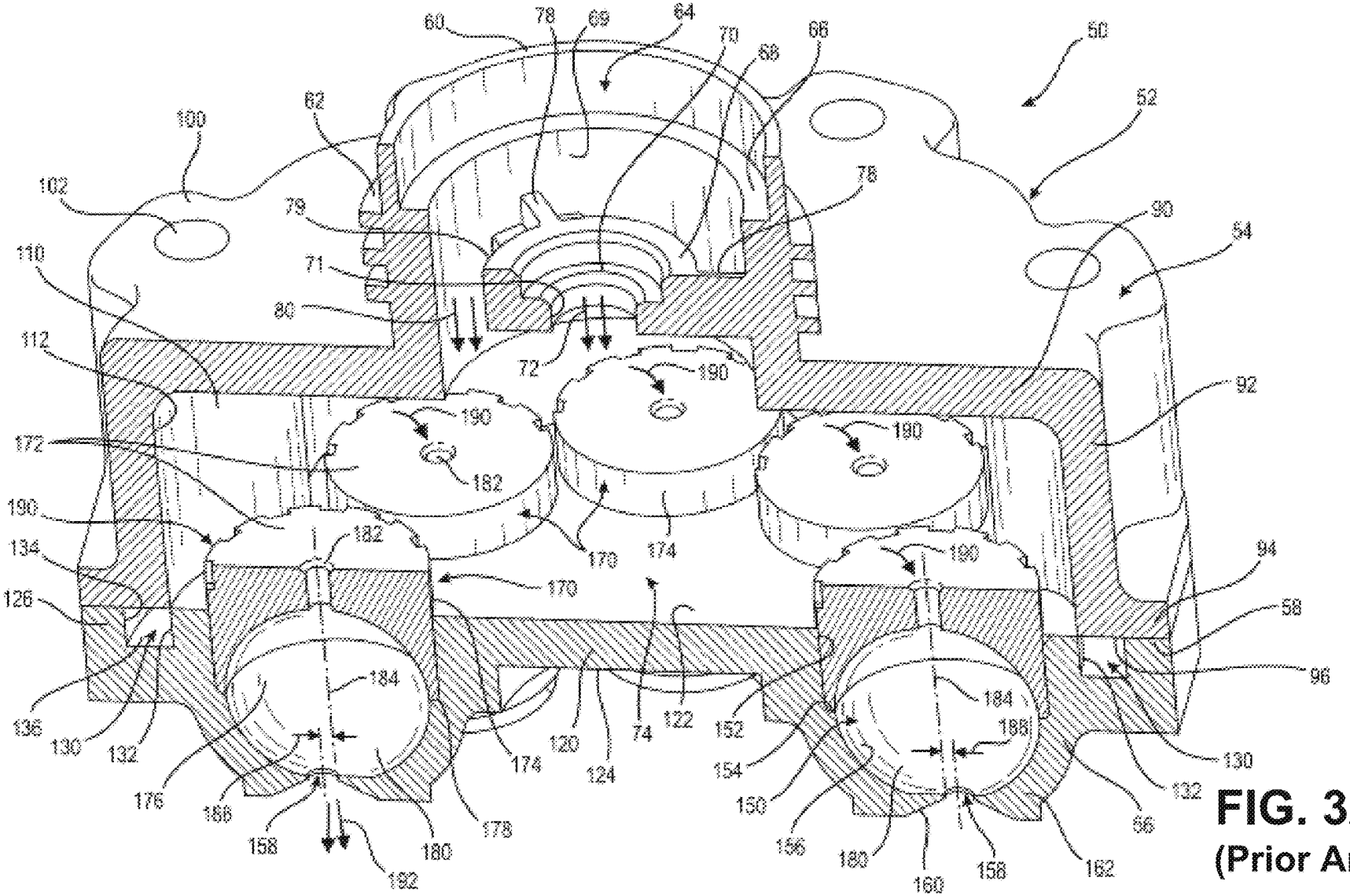
FIG. 3A (Prior Art)
FIG. 3A illustrates a perspective cross-sectional view of a prior art embodiment of a scanner showerhead incorporating eight fluidic oscillators having outlet apertures and throats providing selected scanning spray patterns.
Figure 3B:
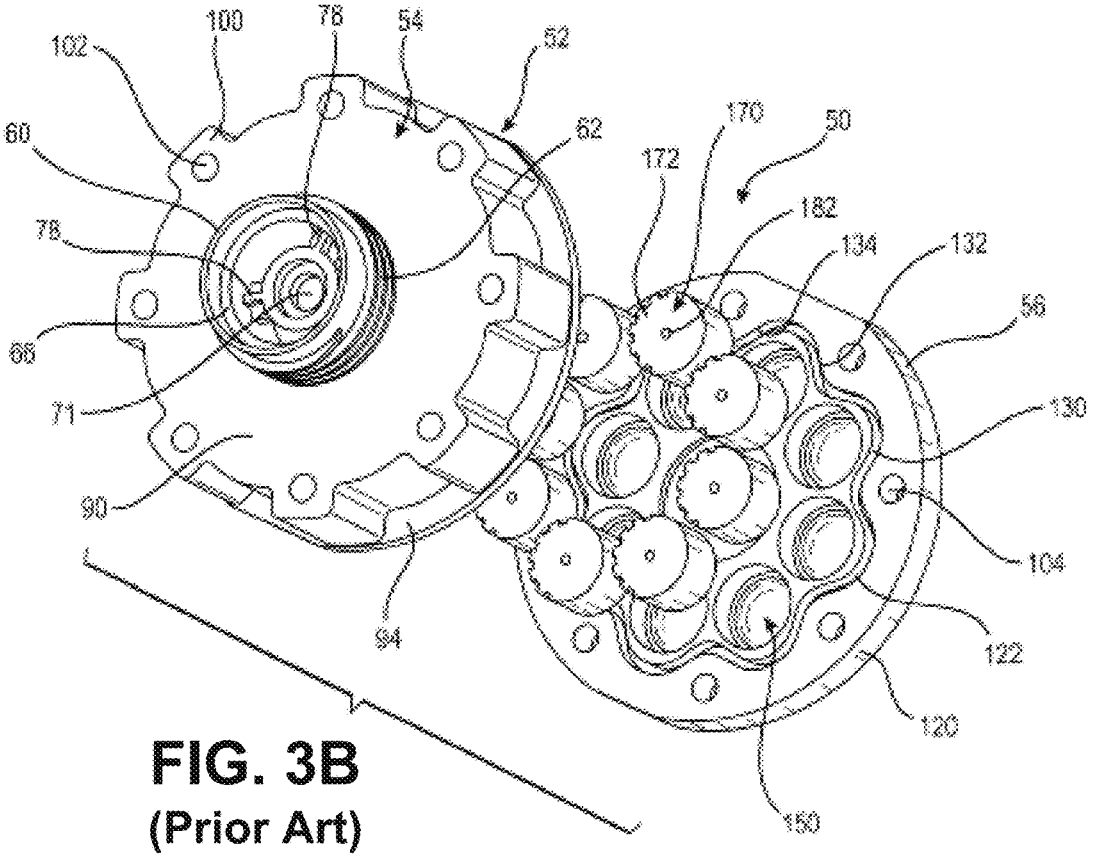
FIG. 3B (Prior Art)
FIG. 3B illustrates an exploded top perspective view of the device of FIG. 3A, illustrating, from left to right, top (or rear) and bottom (or front) housing and internal components according to the prior art.
Figure 3C:
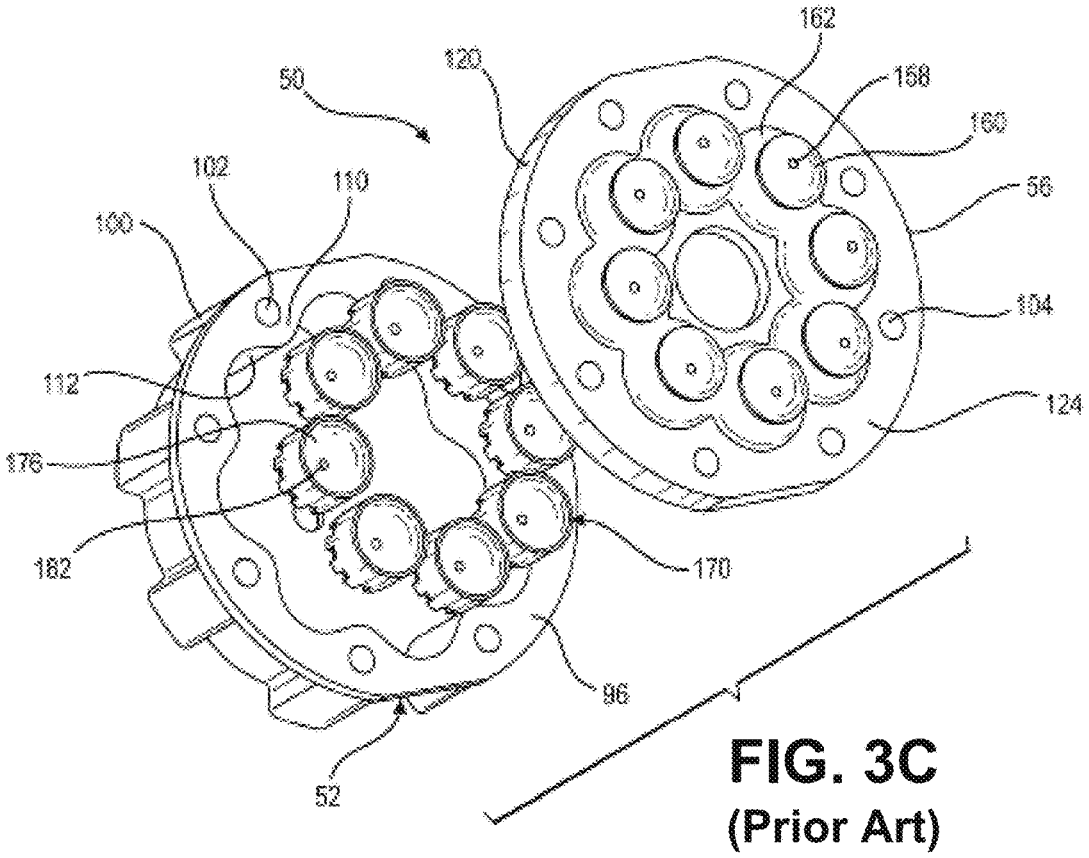
FIG. 3C (Prior Art)
FIG. 3C is an exploded bottom perspective view of the device of FIG. 3A, illustrating, from left to right, top and bottom housing and internal components, according to the prior art.
Figure 3D:
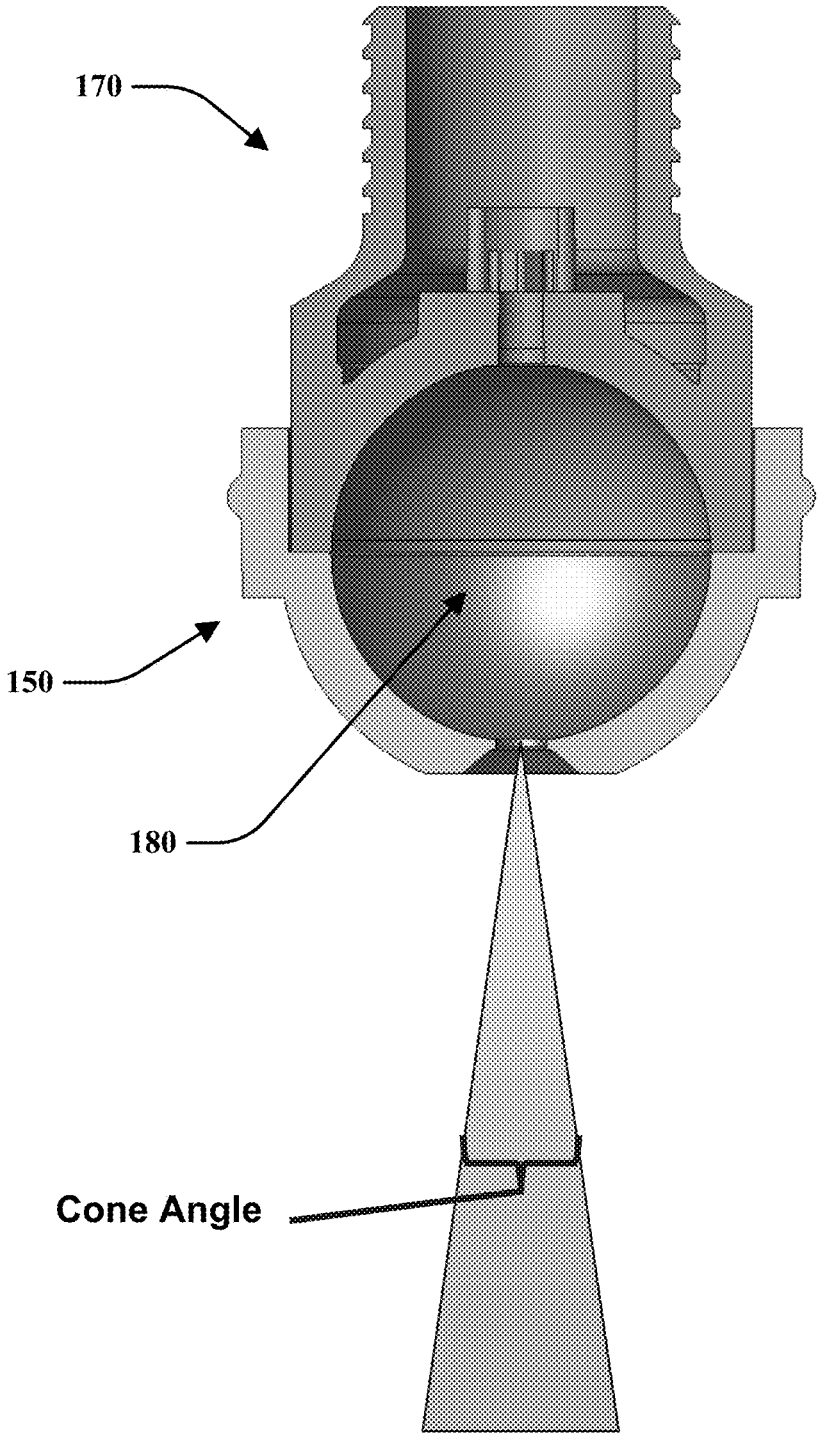
FIG. 3D (Prior Art)
FIG. 3D is a cross sectional side view of a spherical fluidic oscillator circuit according to the device of FIG. 3A
Figure 4A:
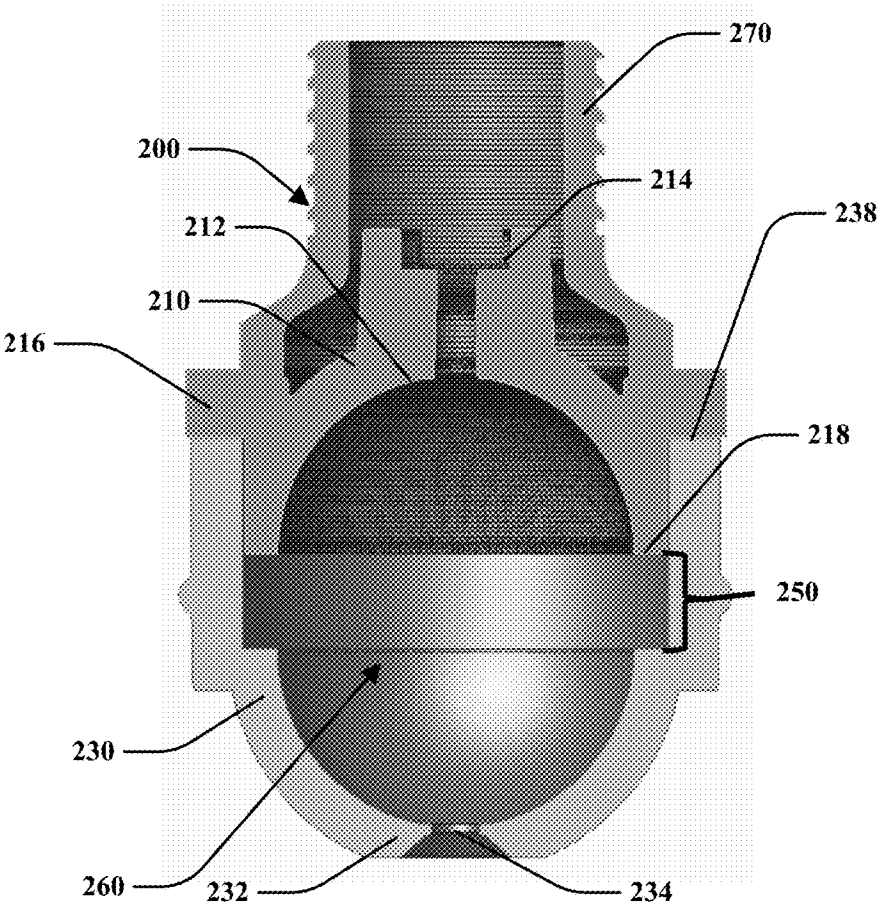
FIG. 4A is a cross-sectional side view of a gapped fluidic oscillator assembly with a stepped gap according to an embodiment of the present disclosure.
Figure 4B:
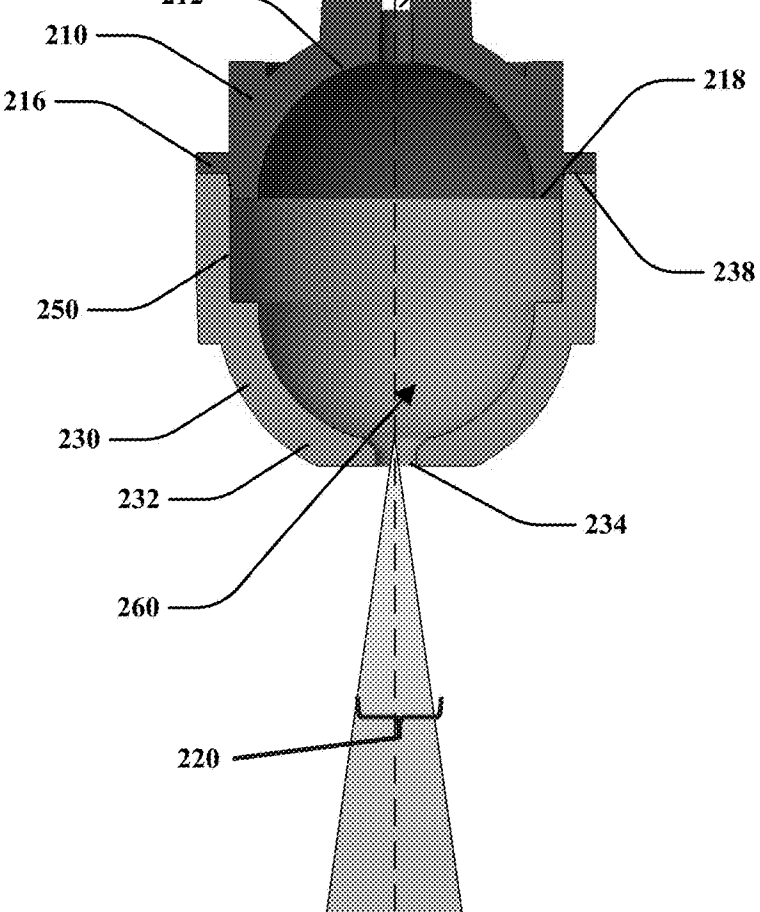
FIG. 4B is a cross-sectional side view of a gapped fluidic oscillator assembly with a stepped gap according to an embodiment of the present disclosure.
Figure 4C:
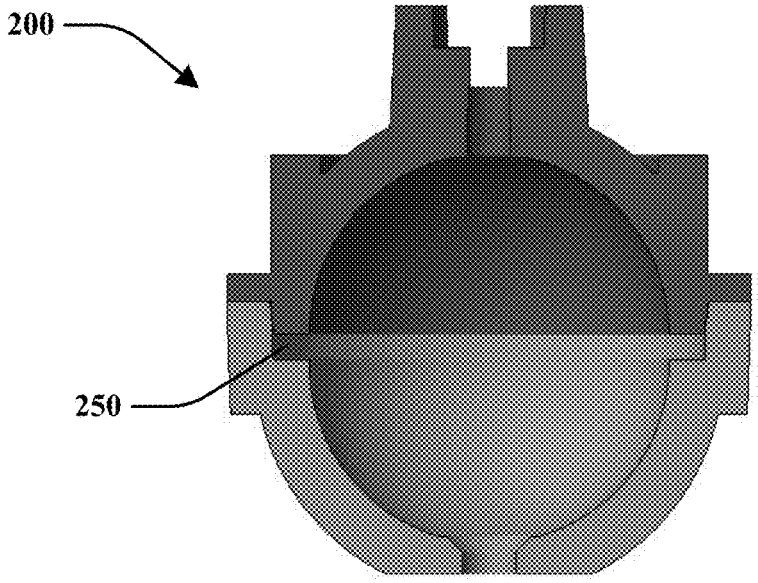
FIG. 4C is a cross-sectional side view of a gapped fluidic oscillator assembly having a shortened stepped gap according to an embodiment of the present disclosure.
Figure 4D:
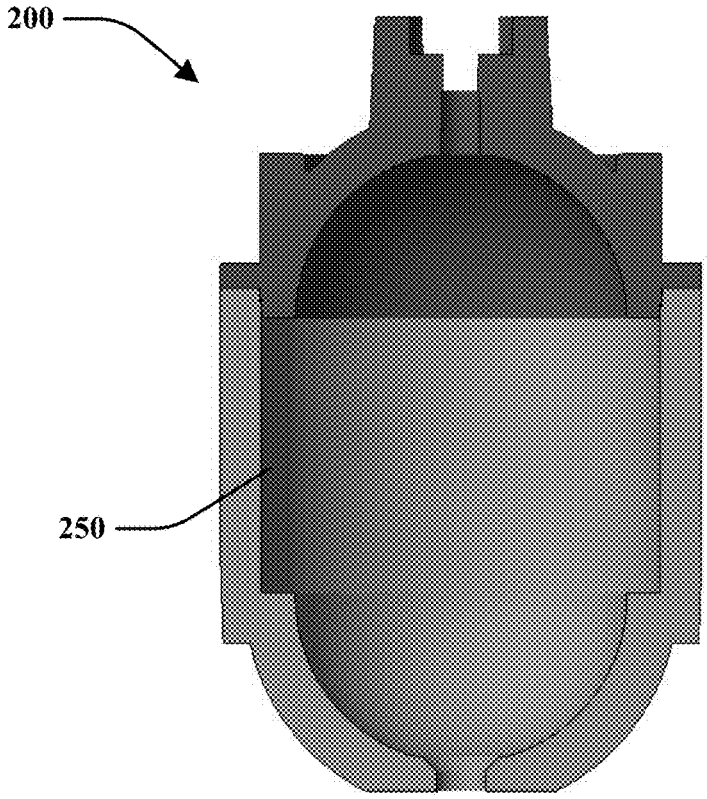
FIG. 4D is a cross-sectional side view of a gapped fluidic oscillator assembly having an elongated stepped gap according to an embodiment of the present disclosure.

FIG. 4A illustrates an embodiment of the nozzle assembly that may be part of a housing having a plurality of nozzle assemblies. This housing may a shower head such as described in FIGS. 3A-3C above. FIG. 4B illustrates an embodiment of the fluidic nozzle assembly 200 that includes a lumen member 270 that extends from the inlet member 210. The lumen member 270 may be fastened to a source of pressurize fluid and may include a plurality of threads for selective attachment thereto. FIG. 4C illustrates an embodiment of the gapped fluidic nozzle assembly 200 having a small axial gap 250 wherein FIG. 4D illustrates an embodiment gapped fluidic nozzle assembly 200 having an elongated axial gap 250.

Figure 5A:
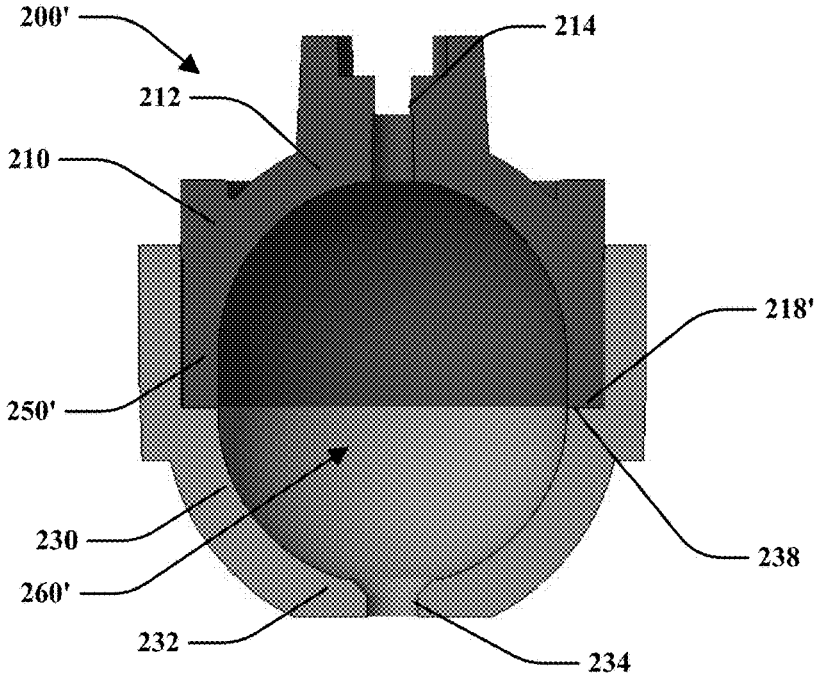
FIG. 5A is a cross-sectional side view of a gapped fluidic oscillator assembly with a continuous gap according to another embodiment of the present disclosure.
Figure 5B:
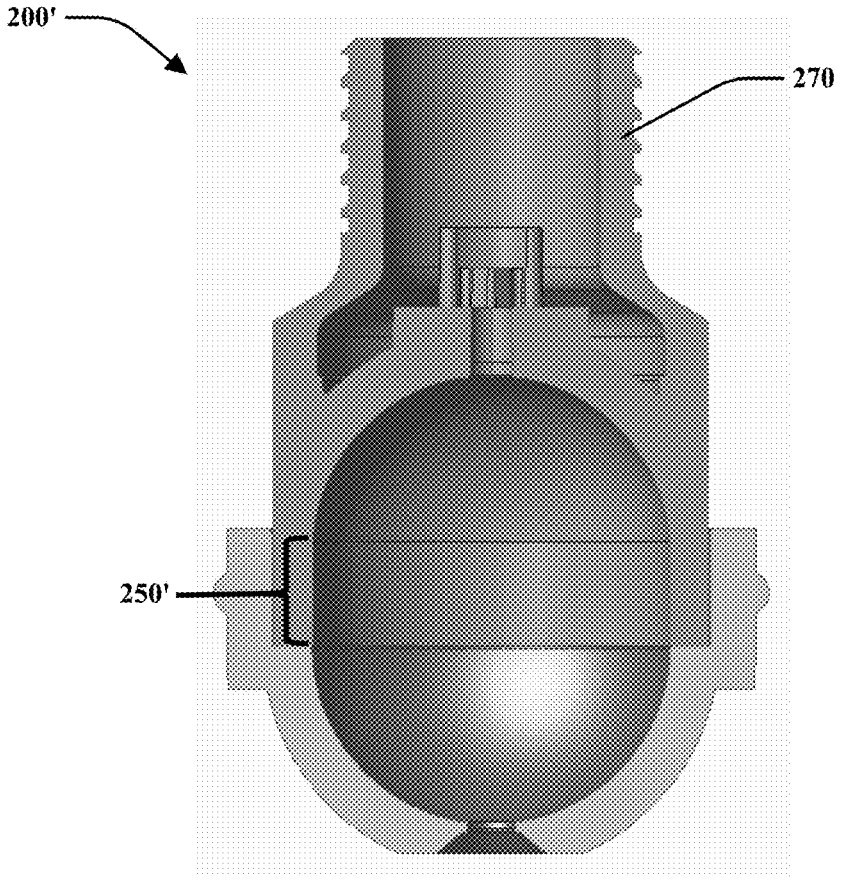
FIG. 5B is a cross-sectional side view of a gapped fluidic oscillator assembly with a continuous gap according to another embodiment of the present disclosure.
Figure 5D:
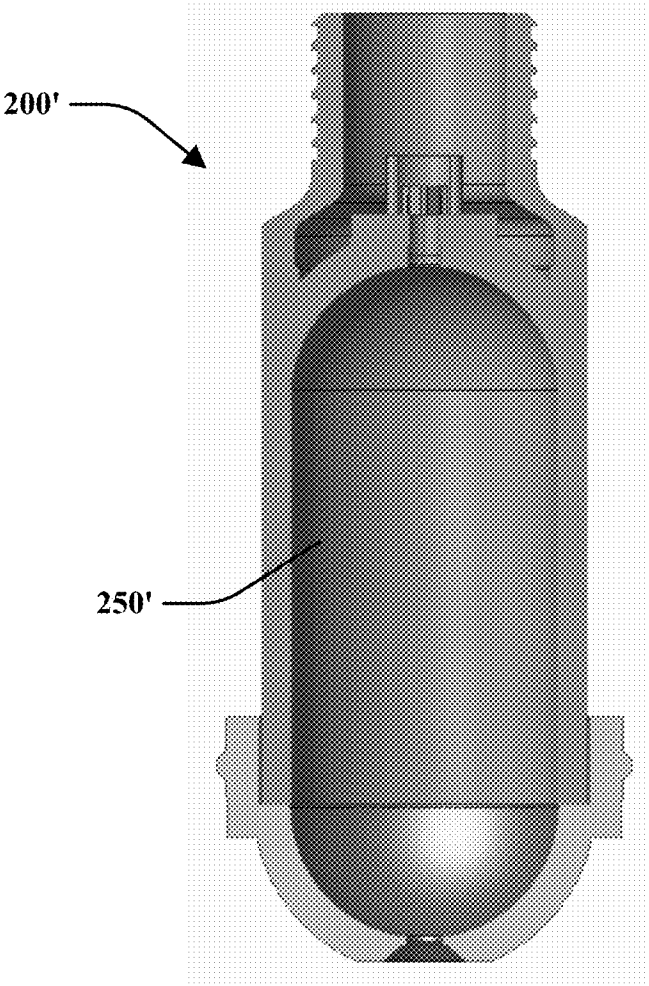
FIG. 5D is a cross-sectional side view of a gapped fluidic oscillator assembly having an elongated continuous gap according to an embodiment of the present disclosure.
Figure 5C:
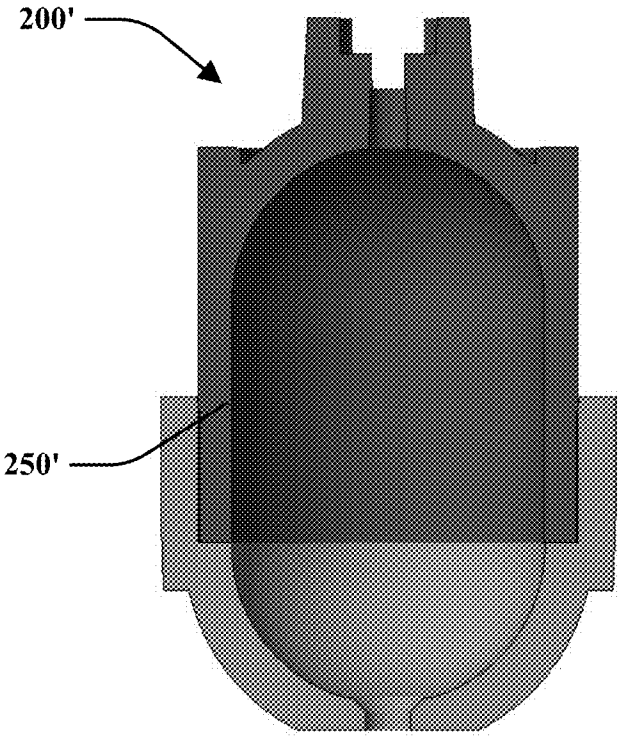
FIG. 5C is a cross-sectional side view of a gapped fluidic oscillator assembly having an elongated continuous gap according to an embodiment of the present disclosure.

As illustrated by FIGS. 5A through 5D, the axial gap may be a continuous axial gap 250'. The continuous axial gap is positioned between a portion of the inlet member and the outlet member such that it has a common continuous diameter with the inlet member 210 and the outlet member 230. Here, the first open end 218' extends longitudinally to abut against the stepped portion 238 of the outlet member 238 thereby defining said continuous axial gap 250'. Here two hemispherical shaped cavities are oppositely positioned relative one another with said continuous axial gap 250' positioned therebetween to define the interaction chamber 260'. FIGS. 5A and 5B illustrate smaller sized continuous axial gaps 250'. FIGS. 5C and 5D illustrate elongated continuous axial gaps 250' while FIGS. 5B and 5D include lumen members 270.

In one embodiment, either nozzle assembly 200, 200' includes the inlet member 210 and outlet member 230 that may be positioned in a front plate so that the bottom of the inlet member 210 engages the ledge or top of the outlet member 230. Their may be a plurality of inlet members 210 inserted within a plurality of outlet members 230 incorporated within a shower head assembly. The inlet members 210 may be secured in place by the tight fit of the outer side wall, thereby forming a fluidic oscillator interaction chambers and corresponding scanning spray outlets and outlet throats. In operation, the shower head is secured to a suitable source of fluid under pressure. The fluid circulates in the chamber and flows at equal flow rates into the several inlet power nozzles 214 and enters the fluidic interaction chambers 260, 260' under pressure, circulates in the chamber to produce a fluidic oscillation, and is ejected through the corresponding outlet aperture 234 to generate from each outlet a scanning fluidic spray output which is delivered in a uniform cone angle, illustrated in FIG. 4A by 220. This scanning spray output may randomly scan across and around the defined cone angle 220 to produce a highly desirable flow pattern for use, for example in a shower.

This scanner nozzle member configuration is well suited for use in a multi-spray nozzle (e.g., showerhead) assembly and the method of the present invention which provides some significant advantages. The simplicity of the scanner nozzle member's geometry, which includes an essentially non-spherical interaction region with coaxial, opposed inlet lumen (power nozzle) and outlet orifice (throat)—and tolerance of a range of gap sidewall lengths allows for simplified construction of scanner fluidic arrays.

All of the scanner throats with the downstream half of the interaction regions (e.g., 230) can be molded in one piece of the showerhead. In this scenario, the power nozzle and upstream half of the interaction region (e.g., 210) are molded individually for each fluidic. The component count for the fluidics is equal to the number of fluidics plus one. This is simpler and more economical to manufacture than other known scanner nozzle assemblies and there are options for greater flexibility and economy making the components are much simpler to design, mold, and assemble, since the axial gap 250 can have a range of tolerable lengths and still provide acceptable performance.

Alternatively, the scanner throats with the downstream half of the interaction regions can be molded in one piece of the showerhead and all of the power nozzles and upstream half of the interaction regions can be molded in one other piece of the showerhead. In this scenario, component count for the fluidics is two, no matter how many fluidics are included. This scenario also allows each showerhead to be designed and built to whatever scanner fluidic geometry is best suited rather than using more or less standard components that are typical in prior fluidic showerheads.

To facilitate the alignment of a large number of fluidics in the assembly, one of the components may be molded out of a flexible material to allow it to conform to the other hard plastic component. To facilitate the alignment of a large number of fluidics in the assembly of the present invention and to allow aiming or bending of the fluidics into various aim angles, both of the components may be molded out of a flexible material to allow them to conform to each other and to a hard face or backing plate that holds prescribed aim angles. The economy inherent in the manufacturing process for making the scanner fluidics and the showerhead nozzle assembly—the non-spherical interaction region's coaxial, opposed inlet (power nozzle) and outlet (throat)—provide the option to economically mold the downstream halves of the interaction regions in the one piece of the showerhead assembly, as discussed above. Since the power nozzle and upstream half of the interaction region are molded individually for each fluidic, the assembly of the showerhead is simplified and the components are much simpler to design and mold.

Notably, the performance of the nozzle assembly 200 having a continuous axial gap relative to the nozzle assemblies having spherical shaped interaction regions disclosed by FIGS. 3A-3C is noted by the table of FIG. 6A. The table of FIG. 6A discloses various measurements related to various gap sizes for fluidic oscillators having a continuous axial gap 250' according to the present disclosure. The nozzle assembly having a continuous axial gap 250' with a longitudinal length that is about 50% of the diameter of the first open end 218 performed with a 1% drop in flow rate and produced a variable fluidic spray that defined about a 35% smaller cone circumference. The nozzle assembly having a continuous axial gap 250 with a longitudinal length that is about the same diameter of the first open end 218 performed with a 2% less flow rate and produced a variable fluidic spray that defined about a 60% smaller cone circumference.

Notably, the performance of the nozzle assembly 200 having a stepped axial gap 250 relative to the nozzle assemblies having spherical shaped interaction regions disclosed by FIGS. 3A-3C is noted by the table of FIG. 6B. The table of FIG. 6B discloses various measurements related to various gap sizes for fluidic oscillators having a stepped axial gap 250 according to the present disclosure. The nozzle assembly having a stepped axial gap 250 with a longitudinal length that is about 50% of the diameter of the first open end 218 performed without significant change in flow rate and produced a variable fluidic spray that defined about a 40% smaller cone circumference. The nozzle assembly having a stepped axial gap 250 with a longitudinal length that is about the same diameter of the first open end 218 performed with a 2% less flow rate and produced a variable fluidic spray that defined about a 60% smaller cone circumference.

It was noted, that the nozzle with stepped axial gap diameter provides better fluid outlet flow stability than with the continuous axial gap. It displays higher frequency conical oscillation, a more uniform spray distribution, reduces risk of unwanted aims, and provides constant conical fluid flow diameter results in a lower frequency of the conical oscillation ("scanning").

Having described preferred embodiments of a new and improved method, it is believed that other modifications, variations and changes will be suggested to those skilled in the art in view of the teachings set forth herein. It is therefore to be understood that all such variations, modifications and changes are believed to fall within the scope of the present invention.

Although the present embodiments have been illustrated in the accompanying drawings and described in the foregoing detailed description, it is to be understood that the gapped fluidic oscillator assemblies are not to be limited to just the embodiments disclosed, but that the systems and assemblies described herein are capable of numerous rearrangements, modifications and substitutions. The exemplary embodiment has been described with reference to the preferred embodiments. Obviously, modifications and alterations will occur to others upon reading and understanding the preceding detailed description. Accordingly, the present specification is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fluidic scanner nozzle comprising:

an interaction chamber defined axially between an upstream end and a downstream end and having a longitudinal chamber axis;

said upstream end having an inlet opening for receiving pressurized fluid and delivering the pressurized fluid into said interaction chamber along said chamber axis, wherein said upstream end is an inlet member that defines an inner cavity having a hemisphere shape;

said downstream end having an outlet orifice for issuing a generally conical outlet spray of liquid droplets from said chamber into an ambient environment wherein said downstream end is an outlet member that defines an inner cavity having a hemisphere shape, wherein the inner cavity of the inlet member is an upper hemisphere shape and the inner cavity of the outlet member is a lower hemisphere shape; and an axial gap positioned between said upstream end and said downstream end of the interaction chamber, wherein said axial gap defines a cylindrical sidewall segment aligned between said inlet member and said outlet member wherein said axial gap within said interaction chamber defines a vortex inducing chamber between the inlet member and the outlet member.

2. The fluidic scanner nozzle of claim 1 wherein the outlet member is configured to receive and be axially aligned with the inlet member in a congruent relationship to form said interaction chamber.

3. The fluidic scanner nozzle of claim 1, wherein said axial gap is positioned between a portion of the inlet member and the outlet member.

4. The fluidic scanner nozzle of claim 1, wherein said axial gap includes a selected axial length and an inside diameter that is wider than an inside diameter of either (a) the inlet member or (b) the outlet member.

5. The fluidic scanner nozzle of claim 1, wherein said axial gap is positioned between a portion of the inlet member and the outlet member and is a stepped axial gap.

6. The fluidic scanner nozzle of claim 1, wherein said axial gap is positioned between a portion of the inlet member and the outlet member and is a continuous axial gap.

7. A fluidic scanner nozzle comprising:

an interaction chamber defined axially between an inlet member and an outlet member and having a longitudinal chamber axis;

said inlet member including an upstream end having an inlet opening for receiving pressurized fluid and delivering the pressurized fluid into said interaction chamber along said chamber axis, wherein said inlet member defines an inner cavity having a hemisphere shape;

said outlet member defines an inner cavity having a hemisphere shape wherein the inner cavity of the inlet member is an upper hemisphere shape and the inner cavity of the outlet member is a lower hemisphere shape and includes a downstream end having an outlet orifice for issuing a generally conical outlet spray of liquid droplets from said chamber into an ambient environment; and an axial gap positioned between said upstream end and said downstream end of said interaction chamber wherein said axial gap defines a sidewall segment aligned between said inlet member and said outlet member wherein said axial gap within said interaction chamber defines a vortex inducing chamber between the inlet member and the outlet member.

8. The fluidic scanner nozzle of claim 7, wherein said inlet member and outlet member are secured and sealed together to define said interaction chamber therebetween, said inlet member including a first open end longitudinally opposite said inlet opening and said outlet member including a second open end longitudinally opposite said outlet orifice, and wherein said first open end is inserted within said second open end.

9. The fluidic scanner nozzle of claim 7 wherein the outlet member is configured to receive and be axially aligned with the inlet member in a congruent relationship to form said interaction chamber.

10. The fluidic scanner nozzle of claim 7, wherein said axial gap defines a cylindrical sidewall segment aligned between an upper hemisphere shaped inner cavity and a lower hemisphere shaped inner cavity.

11. The fluidic scanner nozzle of claim 7, wherein said axial gap includes a selected axial length and an inside diameter that is wider than an inside diameter of either (a) the inlet member or (b) the outlet member.

12. The fluidic scanner nozzle of claim 7, wherein said axial gap is positioned between a portion of the inlet member and the outlet member and is a stepped axial gap.

13. The fluidic scanner nozzle of claim 7, wherein said axial gap is positioned between a portion of the inlet member and the outlet member and is a continuous axial gap.

14. The fluidic scanner nozzle of claim 7, wherein said outlet member further comprises a continuous face having a plurality of outlet members configured to be aligned with a plurality of inlet members within a housing.

15. The fluidic scanner nozzle of claim 14, wherein said housing is a shower head assembly.

* * * * *